United States Patent [19]

Giorgini

[11] 4,290,691

[45] Sep. 22, 1981

[54] METHOD AND APPARATUS USING LOW GLOSS PRESSURE FUSING ROLL

[75] Inventor: Norman L. Giorgini, West St. Paul, Minn.

[73] Assignee: Minnesota Mining and Manufacturing Company, Saint Paul, Minn.

[21] Appl. No.: 84,987

[22] Filed: Oct. 15, 1979

[51] Int. Cl.[3] ..... G03G 15/20; G03G 13/20

[52] U.S. Cl. ..... 355/3 FU; 430/98

[58] Field of Search ..... 355/3 FU, 3 DD; 219/216, 388; 430/98, 99, 124; 118/114, 116

[56] References Cited

U.S. PATENT DOCUMENTS

| | | | |
|---|---|---|---|
| 3,854,975 | 12/1974 | Brenneman et al. | 29/132 X |
| 3,874,894 | 4/1975 | Pedersen | 355/3 DD |
| 4,188,109 | 2/1980 | Idenawa et al. | 219/216 X |
| 4,200,389 | 4/1980 | Matsui et al. | 355/3 FU |

FOREIGN PATENT DOCUMENTS

| | | | |
|---|---|---|---|
| 2718558 | 10/1977 | Fed. Rep. of Germany | 355/3 FU |
| 2351441 | 12/1977 | France . | |

OTHER PUBLICATIONS

*Xerox Disclosure Journal,* p. 99, vol. 2, No. 3, May/Jun. 1977.

*Primary Examiner*—William H. Beha, Jr.

*Attorney, Agent, or Firm*—Cruzan Alexander; Donald M. Sell; James V. Lilly

[57] ABSTRACT

An ambient temperature method of fixing pressure-fixable imaging powder to a receptor so as to produce permanent low gloss image and non-image areas on said receptor and an apparatus useful in the method are provided. The method and apparatus each employ two pressure members. The first member has a compliant, textured surface that engages the imaged surface of the receptor. The second member has a non-compliant, textured surface that engages the non-imaged surface of the receptor.

8 Claims, 3 Drawing Figures

METHOD AND APPARATUS USING LOW GLOSS PRESSURE FUSING ROLL

BACKGROUND OF THE INVENTION

This invention relates to electrostatic duplicating or copying processes and apparati useful therein. More particularly, the invention relates to the ambient temperature fixing of pressure fixable imaging powders to a receptor such as a sheet of paper, and provides a method and an apparatus for permanently fixing such imaging powder to such receptor to produce photocopies that have substantially reduced image and background gloss.

Electrostatic copying processes generally comprise the steps of electrostatically charging a photosensitive substrate, exposing the charged substrate in an imagewise manner, developing the charged image areas with imaging or toner powder, and then permanently fixing the toner powder. In the so-called "transfer process" a permanent photosensitive substrate is employed and the developed image areas are transferred to an expendable receptor, e.g. paper, before the toner is permanently fixed. In the so called "direct process", the substrate and the receptor are the same and comprise an expendable electrostatic copy paper and the toner is permanently affixed to the copy paper without transfer. The present invention provides a method and apparatus for fixing toner powders in both these processes.

Pressure-fixable toners become permanently affixed to the receptor by the application of pressure. These powders generally require that a minimum fixing pressure be applied thereto before the imaging powders are permanently fixed to the receptor. An apparatus which fixes imaging powders by application of pressure must be capable of exerting a pressure on the powder particles in excess of the minimum fixing pressure to cause the particles to coalesce and to fix (i.e., to bond) to the receptor. Generally this pressure is applied by a pair of steel fusing rolls. Most commonly these rolls have a fine surface finish. Pressures in the range of 25 to 400 pounds per lineal inch (4.5 to 71 kg/lineal centimeter) are often required to pressure fix imaging powders at ambient temperature. Such pressures are difficult to maintain and produce fixed images and substrates that are shiny or glossy, thus making the copy difficult to read and aesthetically unpleasant.

Many attempts have been made to eliminate this problem. Usually the attempts take the form of reducing the amount of pressure applied to the fixing rolls. This, however, has not proven entirely satisfactory. Thus, while the non-image or background areas exhibit some reduction in gloss, the image areas exhibit virtually no reduction in gloss. Additionally, the image areas are less permanently fixed to the receptor surface.

SUMMARY OF THE INVENTION

The present invention overcomes this disadvantage of the prior art. It provides a method and an apparatus for ambient temperature pressure fixing of toner powders to a receptor that results in copies that have substantially reduced background and image gloss on the imaged surface. Moreover, the toner powder images are strongly adhered or fixed to the receptor surface.

In one aspect, the present invention provides a method of producing permanent low gloss image and background areas on a receptor surface that includes the steps of forming image areas on a receptor that are comprised of unfixed pressure-fixable imaging powder;

passing said receptor between first and second pressure members that have skewed longitudinal axes with respect to each other to fix said powder to said receptor, the first member having a compliant, textured surface that engages the imaged surface of said receptor, the second said member having a non-compliant, textured surface that engages the non-imaged surface of said receptor wherein said textured surface restricts slippage of said receptor with respect to said second member, the pressure members progressively contacting each other along a narrow nip prior to the passage of said receptor and being adapted to provide sufficient pressure to fix said powder to said receptor while being rotated in opposite directions.

In another aspect, the present invention provides an apparatus in a photocopying machine for fixing a pressure fixable imaging powder to a receptor at ambient temperature so as to provide low gloss image and background areas on the receptor. The apparatus comprises means for providing an image of electrostatically held unfixed, pressure-fixable imaging powder on a surface of said receptor;

first and second pressure members that have skewed longitudinal axes with respect to each other wherein said pressure members progressively contact each other along a narrow nip, the first member having a compliant, textured surface that engages the imaged surface of said receptor, the second member having a non-compliant, textured surface that engages the non-imaged surface of said receptor wherein said textured surface restricts slippage of said receptor with respect to said second member; and means for rotating said pressure members in opposite directions while providing sufficient pressure at their nip to fix said powder to said receptor when said receptor passes between said members.

The receptor may be either plain or electrostatic paper. Preferably the pressure members are cylindrical rolls.

BRIEF DESCRIPTION OF THE DRAWINGS

The present invention is described in greater detail hereinafter with reference to the accompanying drawings wherein like reference characters refer to the same elements in the several views and in which.

DETAILED DESCRIPTION OF THE INVENTION

The present invention is based upon the discovery that the combination of a textured, compliant fixing roll and a textured, non-compliant back-up roll provides low gloss image and background areas on a receptor surface and directs the shear forces developed in the nip of the two rolls to the imaged side of a receptor thereby firmly fixing the toner powder to the receptor.

Figure 1:
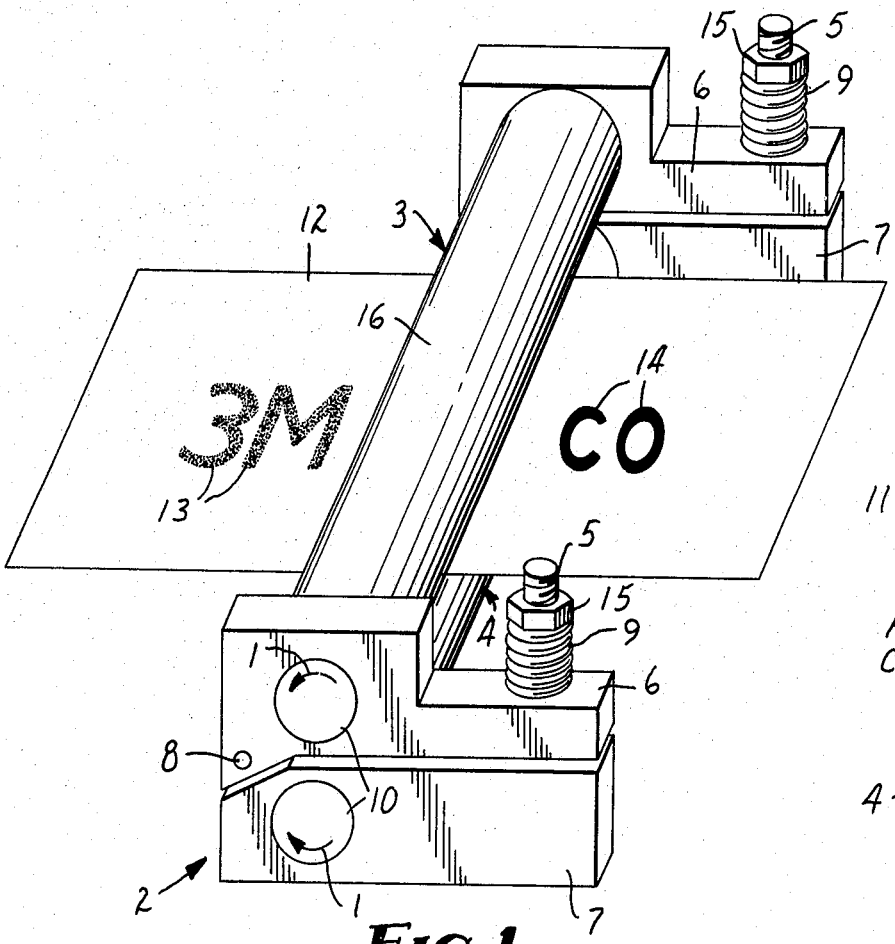
FIG. 1 is a perspective view of a preferred fixing apparatus for use in the photocopy machine of the present invention.

This discovery may be better understood with reference to the drawings. Thus, FIG. 1 illustrates an apparatus 2 for fixing toner powder images. The apparatus 2 comprises a first cylindrical pressure roll 3 (sometimes referred to herein as the fixing roll) and a second cylindrical pressure roll 4 (sometimes referred to herein as the back-up roll). Roll 3 has a compliant, textured surface. Roll 4 has a non-compliant, textured surface. Rolls 3 and 4 are held in position by means of a split journal box that comprises an upper section 6 and a lower section 7. Pin 8 is provided in upper section 6 so that the two sections may be separated to remove the rolls 3 and 4. Upper section 6 pivots about pin 8. Bearings 10 are also provided in each of the sections 6 and 7 of the journal box so that rolls 3 and 4 may rotate therein.

Pressure adjusting means are also provided on the journal box. They each comprise a threaded post 5, a nut 15 and a spring 9. In operation, nut 15 is tightened on post 5 until the desired degree of compression is obtained in spring 9.

FIG. 1 further shows a receptor 12 that has unfixed image areas 13 and fixed image areas 14 thereon. The receptor 12 is situated with respect to apparatus 2 such that fixing roll 3 contacts the unfixed image areas 13 to form fixed image areas 14. Back-up roll 4 contacts the unimaged surface of receptor 12. Fixing roll 3 and back-up roll 4 rotate in opposite directions with respect to each other as is shown by arrows 1.

Figure 2:
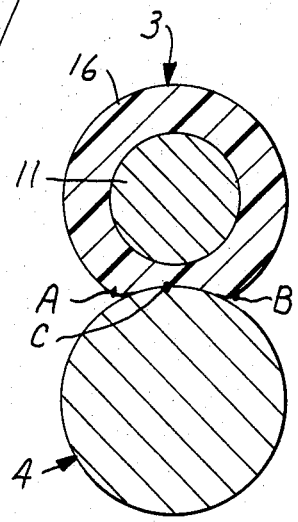
FIG. 2 is a cross sectional view of the pressure members of the showing of an exagerated degree of depression of the compliant role apparatus of FIG. 1.

As can be seen from FIG. 2, fixing roll 3 is preferably made up of a layer of sheath 16 of a compliant material over a central core 11. Layer 16 may be selected from an compliant material and is commonly an organic polymeric substance. A particularly useful material for use as layer 16 is nylon, especially nylon 66. Core 11 may also be selected from a variety of materials. These materials are rigid and preferably non-compliant. Metal cores such as steel cores, are especially useful.

The back-up roll 4 is non-compliant and has a textured surface. The textured surface preferably has a Rockwell C surface hardness of at least about 25.

The textured surface of roll 4 must possess certain physical characteristics. Thus, the textured surface must culminate in well defined or sharp peaks or projections. This enables back-up roll 4 to contact a receptor with sharp points of contact. Additionally, because back-up roll 4 and fixing roll 3 contact each other along a narrow nip when a receptor is not passing between them, the textured surface of back-up roll 4 renews the textured surface of fixing roll 3. This adds longevity to the useful life of fixing roll 3 and maintains the effectiveness of this roll in reducing the gloss of the resultant copies.

Back-up roll 4 may be selected from a number of rigid, non-compliant substances. Preferably it comprises a metal such as steel.

The textured pressure members employed in the method and apparatus of the present invention may be easily prepared. Thus, for example, the back-up roll 4 may have the appropriate textured surface applied to it by sandblasting its surface. Alternatively, the appropriate textured surface may be applied to back-up roll 4 by acid etching its surface.

The fixing roll 3 may have the appropriate textured surface applied to it by merely contacting the back-up roll. Thus, the fixing apparatus may be assembled with a textured back-up roll and a smooth, but compliant fixing roll; the pressure on the two rolls set at, for example, 190 pounds per linear inch (34.2 kg/linear cm); and the two rolls rotated in opposite directions with respect to each other for a short period of time (e.g., about 1 minute).

As noted above, directing the shear forces developed in the nip of two cooperating pressure members, here rolls 3 and 4, to the imaged side of a receptor has surprising results. This may be better understood by reference to FIGS. 2 and 3. Thus, with reference to these Figures, it may be generally stated that the rotational speed (in revolutions per unit time) of rolls 3 and 4 is related to the speed of any point on the surface of such roll by the equation $$S=2\,rN$$

where S=surface speed; r=radius of the roller; and N=rotational speed.

It is readily seen from this equation that the speed of any point on the surface of a roll is a function of the rotational speed of the roll and the radial distance from the point to the center or longitudinal axis of the roll. Thus for example, non-compliant, cooperating rolls, i.e., rolls which contact each other essentially only along a line, will have equal surface speeds at all points on their respective surfaces.

When, on the other hand, one of the rolls is compliant and the other is non-compliant, the non-compliant roll is depressed along a portion of the surface of the compliant roll as is shown in FIG. 2. From point A, where non-compliant roll 4 first depresses compliant roll 3, to point B, where the two rolls disengage (this path of engagement being referred to as the nip), the radius of the compliant roller is reduced from a maximum at point A to a minimum at point C and is then increased back to a maximum at point B. According to the above equation, the surface speed of fixing roll 3 is, therefore, less than that of back-up roll 4 throughout the nip, and hence shear (as defined above) is encountered in the nip.

Figure 3:
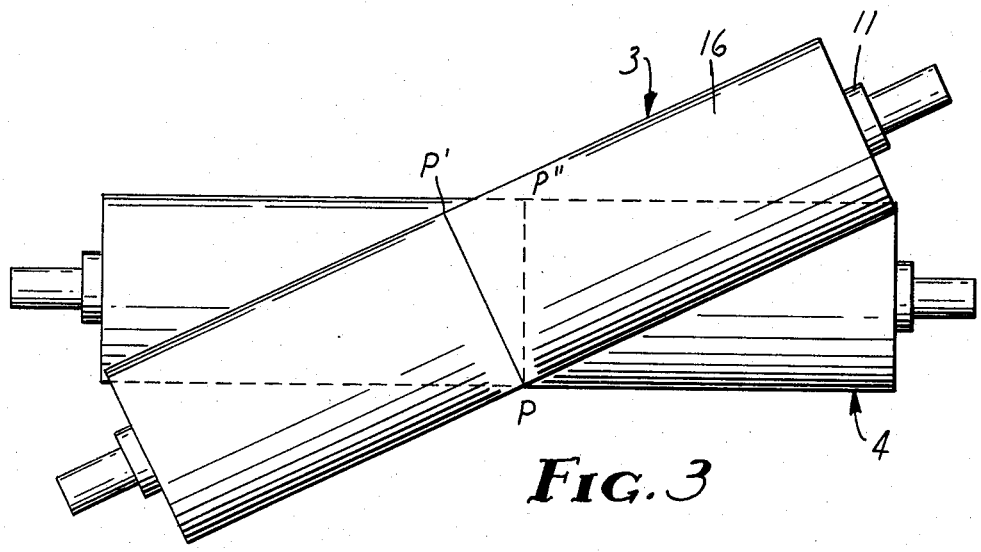
FIG. 3 is an exaggerated plan view of the skewed pressure rolls of FIG. 1.

Shear forces also arise from another source in the device of the present invention. As noted above, the pressure members of the present invention are skewed, i.e., their respective longitudinal axes are not parallel. This is shown in FIG. 3 in an exaggerated fashion. A given point P on the surface of fixing roll 3 follows a path P-P'. This path is perpendicular to the longitudinal axis of roll 3. Similarly point P follows a path P-P'' (indicated by the dotted line) on the surface of back-up roll 4.

When a receptor passes through the nip formed by rolls 3 and 4, shear forces are exerted upon both receptor 12 and a loose powder 13 image thereon. Fixing roll 3 tends to force the imaged surface of receptor 12 and a toner particle to follow path P-P' while in the nip and fixing roll 4 tends to force the non-imaged surface of receptor 12 to follow path P-P''. The net result of these two forces is that additional shear is applied to the toner particle.

The results achieved with the present invention are even more unexpected when one considers that shear forces generally act or are relieved at the point of least resistance. In conventional ambient temperature fixing assemblies, the back-up and fixing rolls are each very smooth, i.e. they have a fine surface finish. In this instance the shear will act at the back or non-imaged surface of the receptor, the front or imaged surface of the receptor, or partially at both. In this situation the image and background areas are glossy and there may be inconsistent fusing of the image areas. If a smooth back-up roll and a textured image roll were employed, it is likely that any shear developed in the nip of the fixing and back-up rolls would be relieved on the back (or non-imaged side) of the receptor. In the latter instance, however, relief of shear on the back of the receptor has no beneficial effect so that the image areas are not firmly adhered. Furthermore continuous operation would result in polishing the image roll so that ultimately the copies produced would have shiny image and background areas.

A back-up roll that has a textured surface that thereby restricts movement of the receptor with respect thereto (i.e. which restricts slippage) directs shear to the toned (or imaged) side of the receptor, where relief of shear has its optimum effect on toner fixing. Hence an unexpected advantage of the present invention is its ability to develop and control shear so that it can be optimally employed to fix imaging powder to a substrate.

Actual fixing of the toner powder to the receptor occurs when the shear is relieved. Relief of shear effectively amounts to smearing the imaging powder into the receptor so that the powder is adherently bonded or fixed thereon. The shear developed in the present invention is not sufficient to make copies produced appear to be smeared to visual examination. However, the images fixed on the receptor are permanently fixed.

The present invention is further described in the following examples.

EXAMPLES 1-3

The image and background gloss of copies prepared according to the method and using the apparatus of the present invention was compared with the image and background gloss of copies prepared according to conventional techniques and using known equipment.

The photocopiers employed throughout these examples were VQC III copiers from 3M Company. When the present invention was used to prepare the copies, the standard fixing station of the copier was replaced with the device of the invention. When the known techniques and equipment were employed, the standard VQC III fixing station was employed. This fixing station utilized smooth steel rolls. The toner powder employed throughout the examples was Type 371 toner powder, a pressure-fixable toner powder available from 3M Company.

After the copies were made, the gloss of the image and background areas was determined by a Hunter Lab Model D-16 Multipurpose Gloss Meter available from Hunter Associates Laboratories Incorporated of Fairfax, Virginia. The angle of the incident light was 75° from vertical. The technique for measuring gloss is described in the Technical Association of Pulp and Paper Industries test method T-4800os-72.

The fixing pressures employed, and the gloss numbers obtained are given in Table 1. High values for the gloss number indicate high gloss on the copy. The gloss values reported represent the average range obtained. Each average was calculated from twenty-seven readings.

TABLE 1

| | SURFACE | | | GLOSS VALUE | |
|---|---|---|---|---|---|
| EXAMPLE | FIXING ROLL | BACK-UP ROLL | FIXING PRESSURE | IMAGE | BACKGROUND |
| 1 | Textured | Textured | 150 lbs/linear in. (27 kg/linear cm) | 16-20 | 10-14 |
| 2 | Smooth | Smooth | 125 lbs/linear in. (22.5 kg/linear cm) | 32-40 | 23-28 |
| 3 | Smooth | Smooth | 180 lbs/linear in. (32.4 kg/linear cm) | 45-55 | 35-40 |

This data clearly demonstrates the unexpected results achieved by practice of the present invention. Thus, the copies produced in Example 1 had a matte-like finish as is shown by their low image and background gloss values. The images were strongly fixed to the receptor.

The copies produced in Examples 2 and 3 each were shiny in both the background and image areas. This is clearly shown by their high gloss values. While the use of lower fixing pressure in Example 2 did reduce the gloss values somewhat when compared to the gloss values of Example 3, the copies produced still were shiny. Moreover, where Example 2 is repeated at lower pressure, the resultant copies do not exhibit significant improvement in gloss values but do exhibit a significant reduction in the adherance of the images to the paper.

The preceding disclosure describes the more preferred aspects of the present invention. However, minor variations of the invention are possible and will be obvious to those skilled in the art as a result of this disclosure. These variations are included within the scope of the accompanying claims.

What is claimed is:

1. An ambient temperature method of fixing pressure-fixable imaging powder to a receptor so as to produce permanent low gloss image and background areas on said receptor, the method including the steps of forming image areas on said receptor that are comprised of unfixed pressure-fixable imaging powder;

passing said receptor between first and second pressure members that have skewed longitudinal axes with respect to each other to fix said powder to said receptor, the first member having a compliant, textured surface that engages the imaged surface of said receptor, the second member having a non-compliant, textured surface that engages the non-imaged surface of said receptor, wherein said textured surface of said second member restricts slippage of said receptor with respect to said second member, and wherein the textured surface of said second member has sharp peaks thereon, the pressure members progressively contacting each other along a narrow nip therebetween prior to the passage of said receptor and being adapted to provide sufficient pressure to fix said powder to said receptor while being rotated in opposite directions.

2. A method according to claim 1 wherein said first and second members are each cylindrical rolls.

3. A method according to claim 2 wherein said second cylindrical roll has a Rockwell C surface hardness of at least about 25.

4. A method according to claim 3 wherein said first cylindrical roll comprises nylon.

5. In a photocopy machine, an assembly for fixing pressure-fixable imaging powder to a receptor at ambient temperature so as to produce permanent low gloss image and non-image areas on said receptor, said assembly comprising:

means for providing an image of electrostatically held, unfixed, pressure-fixable imaging powder on a surface of said receptor;

first and second pressure members that have skewed axes with respect to each other, wherein said pressure members contact each other along a narrow nip therebetween, the first member having a compliant, textured surface that engages the imaged surface of said receptor, the second member having a non-compliant, textured surface that engages the non-imaged surface of said receptor, wherein said textured surface of said second member restricts slippage of said receptor with respect to said second member, and wherein said textured surface of said second member has sharp peaks thereon; and means for rotating said pressure members in opposite directions while providing sufficient pressure at their nip to fix said powder to said receptor when said receptor passes between said members.

6. A photocopy machine according to claim 5 wherein said pressure members are each cylindrical rolls.

7. A photocopy machine according to claim 6 wherein said second cylindrical roll has a Rockwell C surface hardness of at least about 25.

8. A photocopy machine according to claim 7 wherein said first cylindrical roll comprises nylon.

* * * * *

UNITED STATES PATENT AND TRADEMARK OFFICE

CERTIFICATE OF CORRECTION

PATENT NO. : 4,290,691

DATED : September 22, 1981

INVENTOR(S) : Norman L. Giorgini

It is certified that error appears in the above—identified patent and that said Letters Patent is hereby corrected as shown below:

Col. 6, line 54, Claim 1, "progressively" should be deleted.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*